US009970145B2

(12) United States Patent
Kim et al.

(10) Patent No.: US 9,970,145 B2
(45) Date of Patent: May 15, 2018

(54) FABRIC TREATING MACHINE

(75) Inventors: Young Jong Kim, Changwon-si (KR); Hyuk Soo Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1259 days.

(21) Appl. No.: 13/387,987

(22) PCT Filed: Jul. 29, 2010

(86) PCT No.: PCT/KR2010/005004

§ 371 (c)(1),
(2), (4) Date: Apr. 16, 2012

(87) PCT Pub. No.: WO2011/014029

PCT Pub. Date: Feb. 3, 2011

(65) Prior Publication Data

US 2012/0186307 A1 Jul. 26, 2012

(30) Foreign Application Priority Data

Jul. 31, 2009 (KR) ..... 10-2009-0071064
Jul. 31, 2009 (KR) ..... 10-2009-0071065

(51) Int. Cl.
*D06F 37/20* (2006.01)
*D06F 37/24* (2006.01)

(52) U.S. Cl.
CPC ..... *D06F 37/24* (2013.01); *D06F 37/20* (2013.01); *D06F 37/206* (2013.01)

(58) Field of Classification Search
CPC .... D06F 37/206; D06F 37/264; D06F 37/267; D06F 37/269; D06F 37/20
See application file for complete search history.

(56) References Cited

U.S. PATENT DOCUMENTS

2006/0096329 A1* 5/2006 Kim et al. ..... 68/3 R
2006/0125150 A1* 6/2006 Gomez Caudevilla ..... D06F 37/262 264/328.8
2007/0138902 A1* 6/2007 Ahn et al. ..... 310/261
2008/0148785 A1* 6/2008 Lee ..... D06F 37/20 68/140

(Continued)

FOREIGN PATENT DOCUMENTS

JP 10-272288 A 10/1998
KR 10-1998-0043343 A 9/1998

(Continued)

*Primary Examiner* — Marc Lorenzi
(74) *Attorney, Agent, or Firm* — Birch, Stewart, Kolasch & Birch, LLP

(57) ABSTRACT

A fabric treating machine according a present invention comprises a first vibration mitigation part which is disposed between a stator and a bearing unit. Therefore, it can reduce the transfer of the vibration from the driving unit to the bearing unit, and the vibration of an inner tub and an outer tub can be reduced, and a noise can be reduced. Thus, a reliability of product can be improved. Also, a fabric treating machine according a present invention comprises a vibration mitigation part which is disposed between an upper bearing unit and a lower bearing unit. Therefore, it can reduce the vibration transfer from the lower bearing unit to the upper bearing unit, and the vibration of an inner tub and an outer tub can be reduced, and a noise can be reduced.

8 Claims, 12 Drawing Sheets

(56) References Cited

U.S. PATENT DOCUMENTS

| | | | | |
|---|---|---|---|---|
| 2009/0044574 | A1* | 2/2009 | Lim et al. | 68/23.1 |
| 2009/0100879 | A1* | 4/2009 | Kim et al. | 68/140 |
| 2009/0113941 | A1* | 5/2009 | Kim | D06F 37/20 68/140 |
| 2009/0113942 | A1* | 5/2009 | Ha | D06F 37/262 68/140 |
| 2009/0113943 | A1* | 5/2009 | Lee | D06F 37/206 68/140 |
| 2009/0260939 | A1* | 10/2009 | Golden | B22D 19/00 188/381 |

FOREIGN PATENT DOCUMENTS

| | | | |
|---|---|---|---|
| KR | 10-2003-0050285 | A | 6/2003 |
| KR | 10-2003-0050286 | A | 6/2003 |
| KR | 10-2004-0013992 | A | 2/2004 |
| KR | 10-2005-0053211 | A | 6/2005 |
| KR | 10-2005-0110072 | A | 11/2005 |
| KR | 10-2005-0121013 | A | 12/2005 |
| KR | 10-2006-0088237 | A | 8/2006 |
| KR | 10-2009-0046063 | A | 5/2009 |
| KR | 10-2009-0046745 | A | 5/2009 |

* cited by examiner

[Fig. 1]
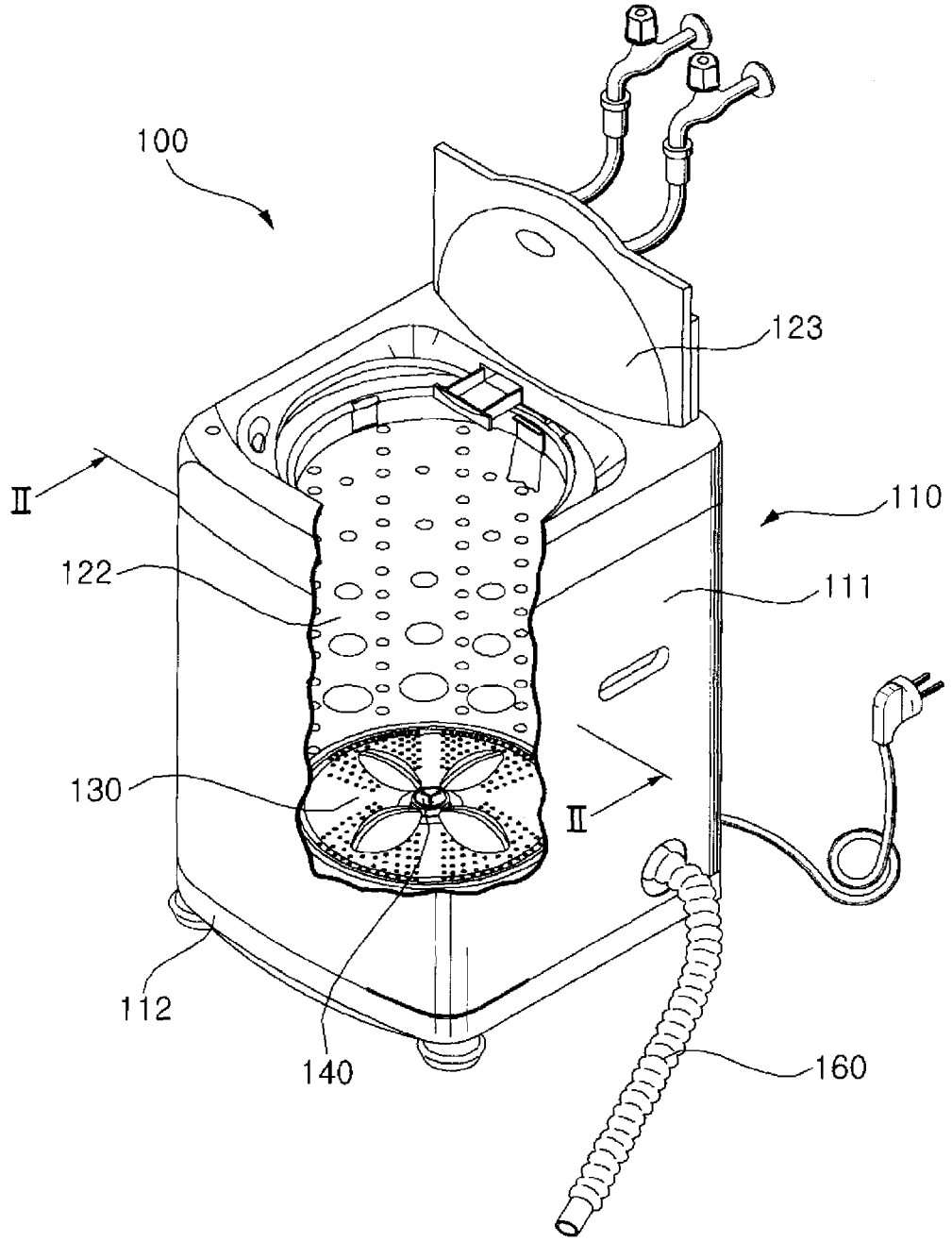

[Fig. 2]
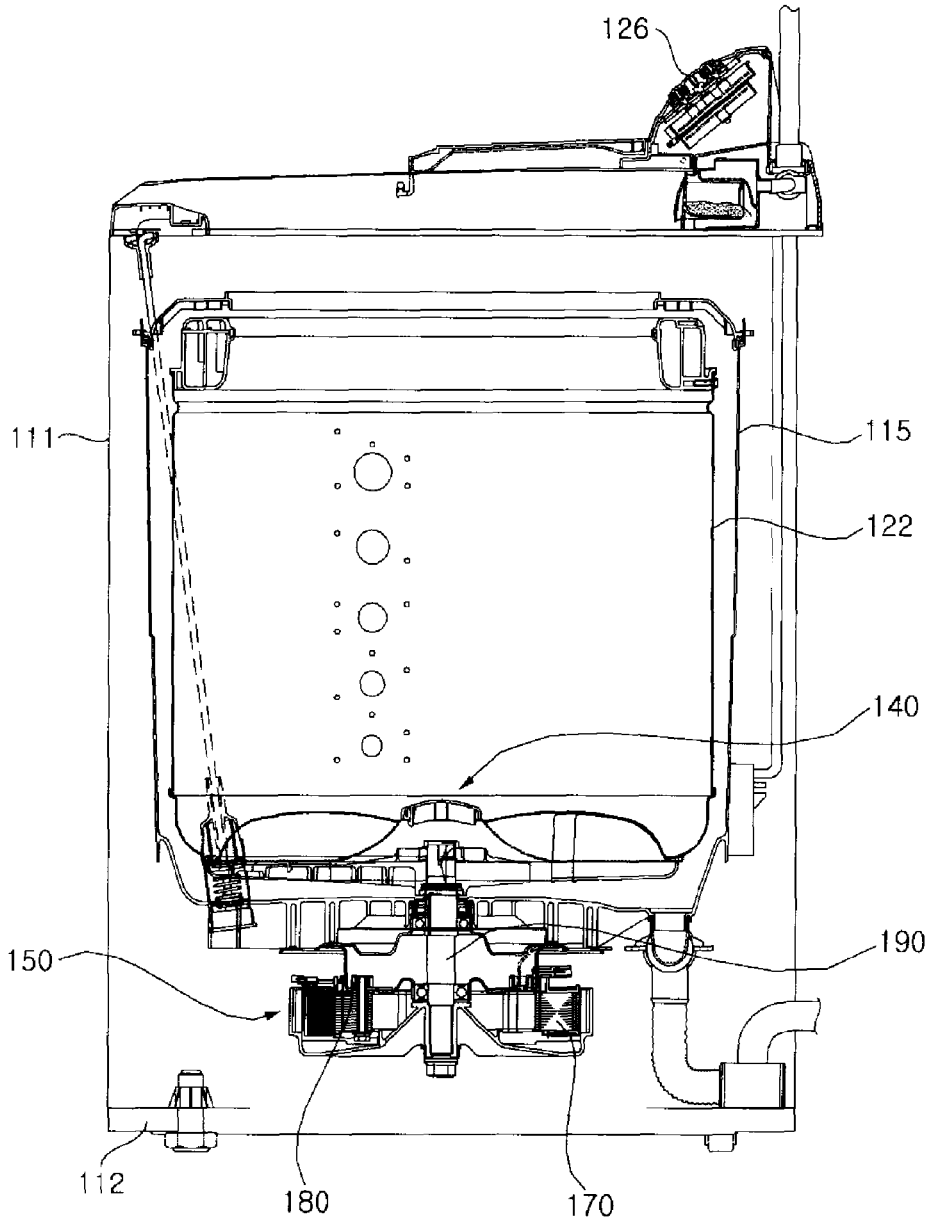

[Fig. 3]
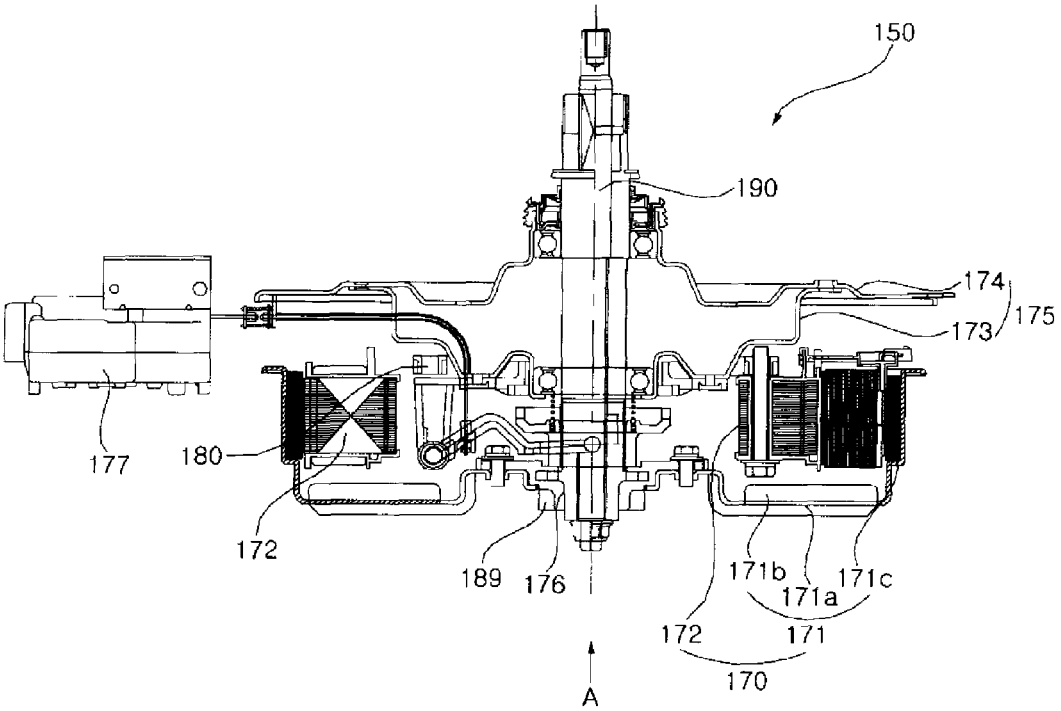
[Fig. 4]
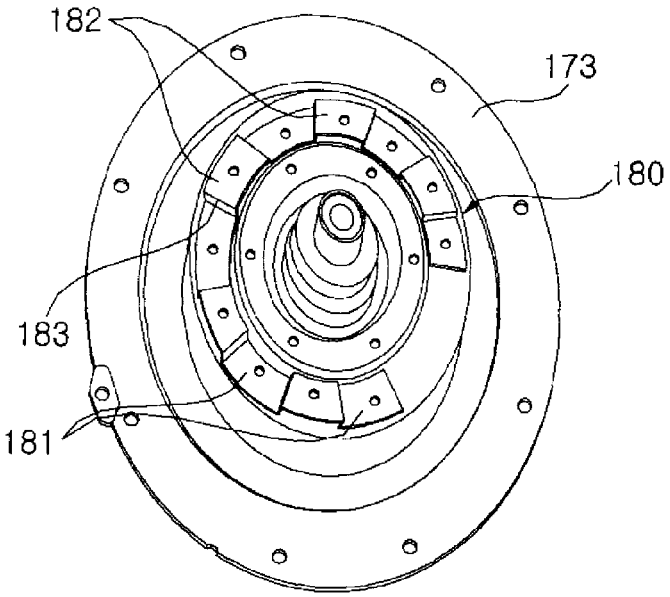

[Fig. 5]
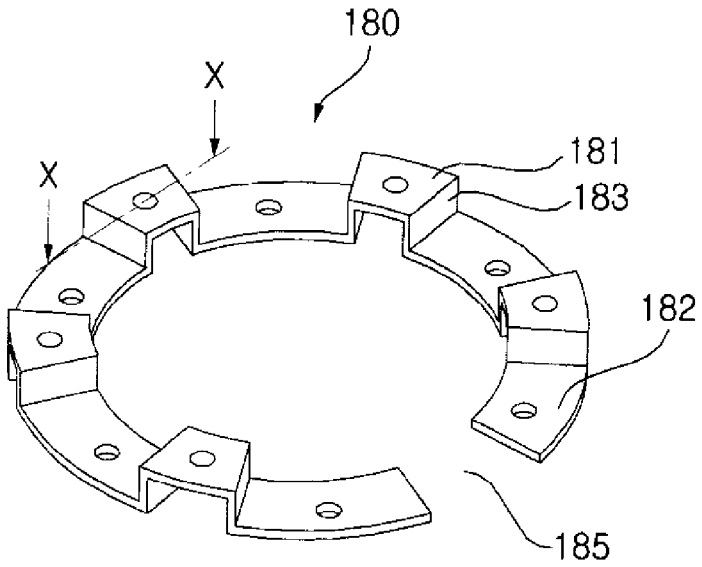
[Fig. 6]
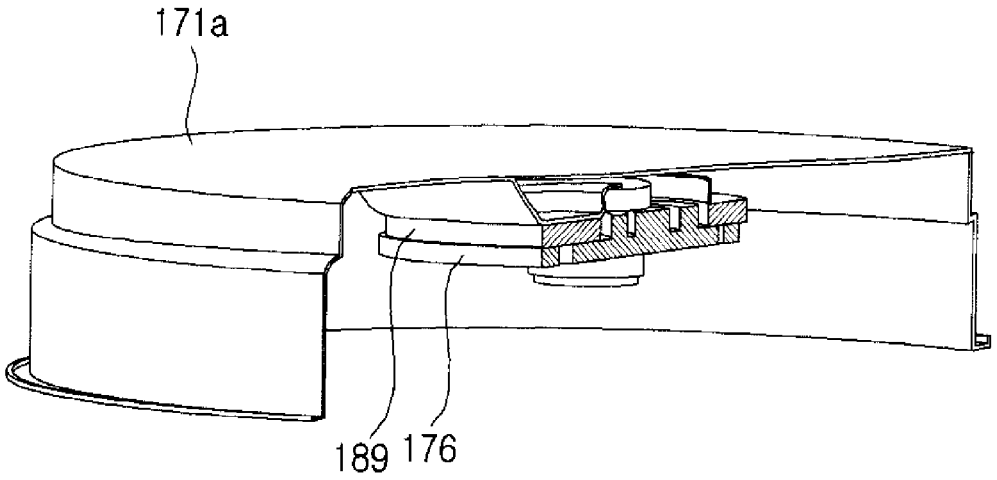

[Fig. 7]
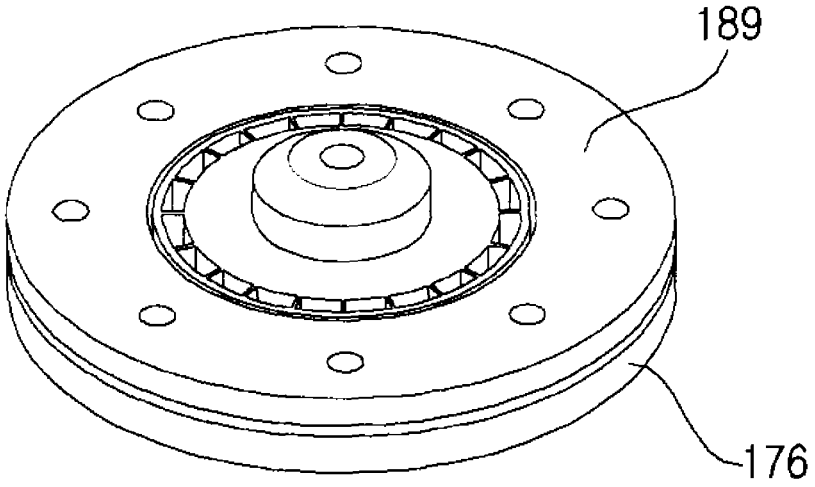
[Fig. 8]
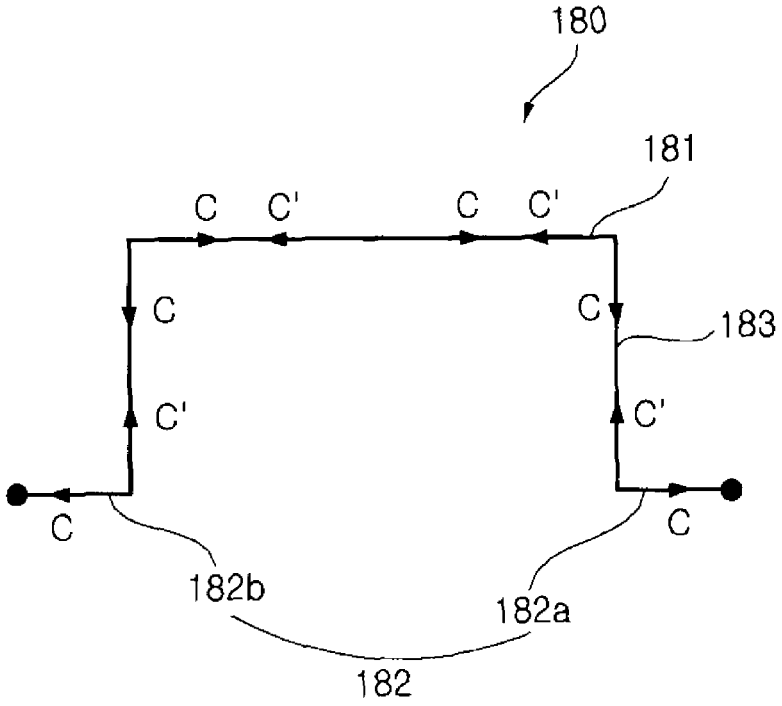

[Fig. 9]
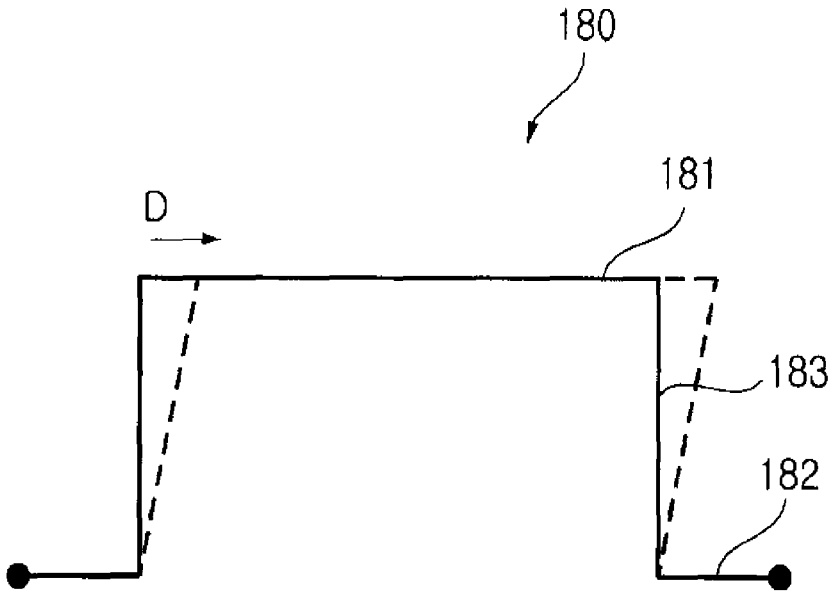
[Fig. 10]
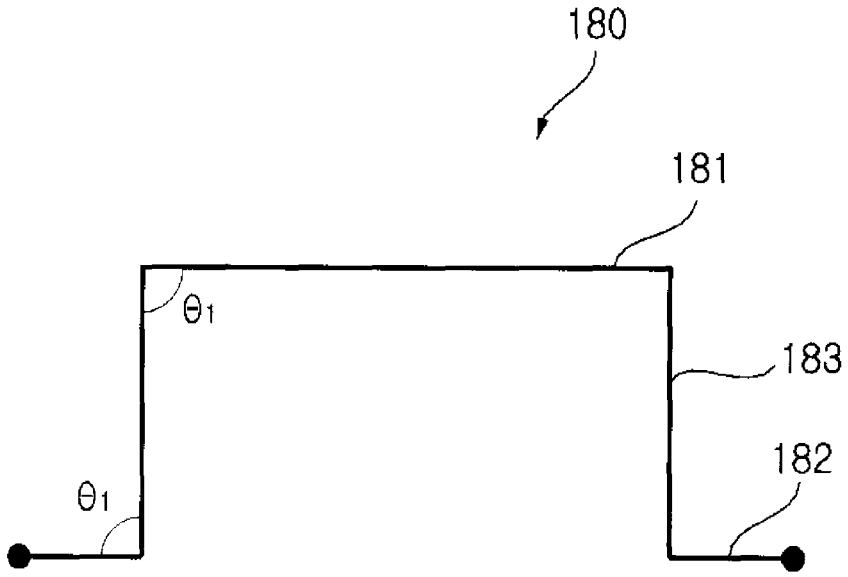

[Fig. 11]
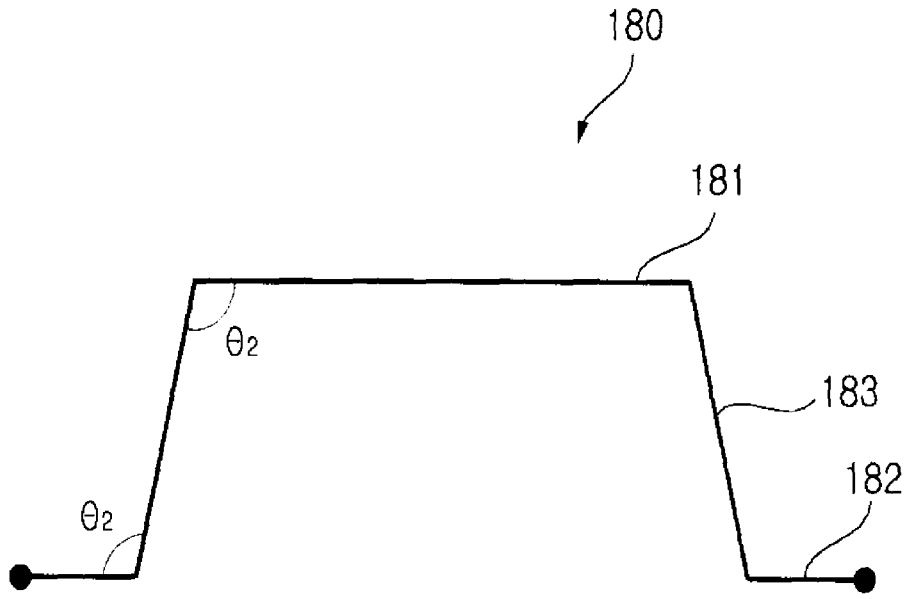
[Fig. 12]
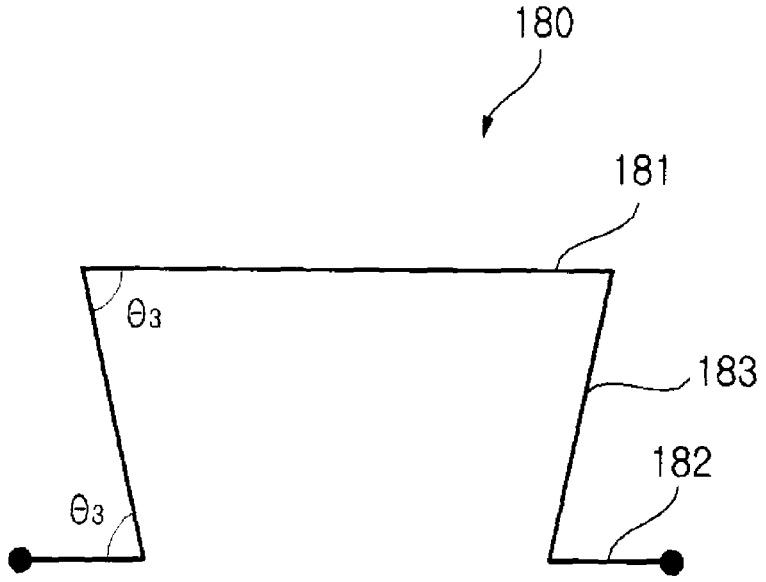

[Fig. 13]
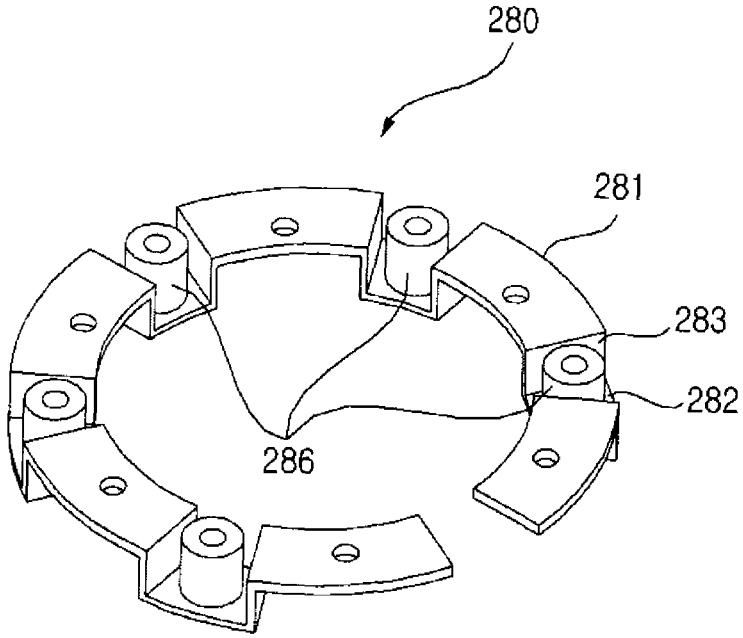
[Fig. 14]
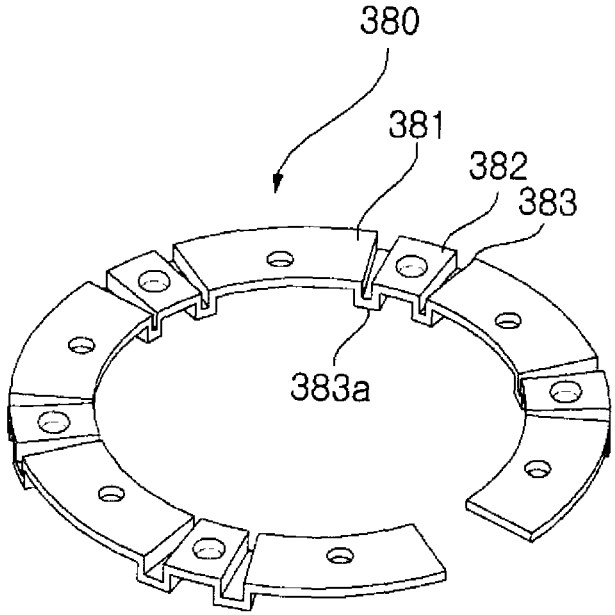

[Fig. 15]
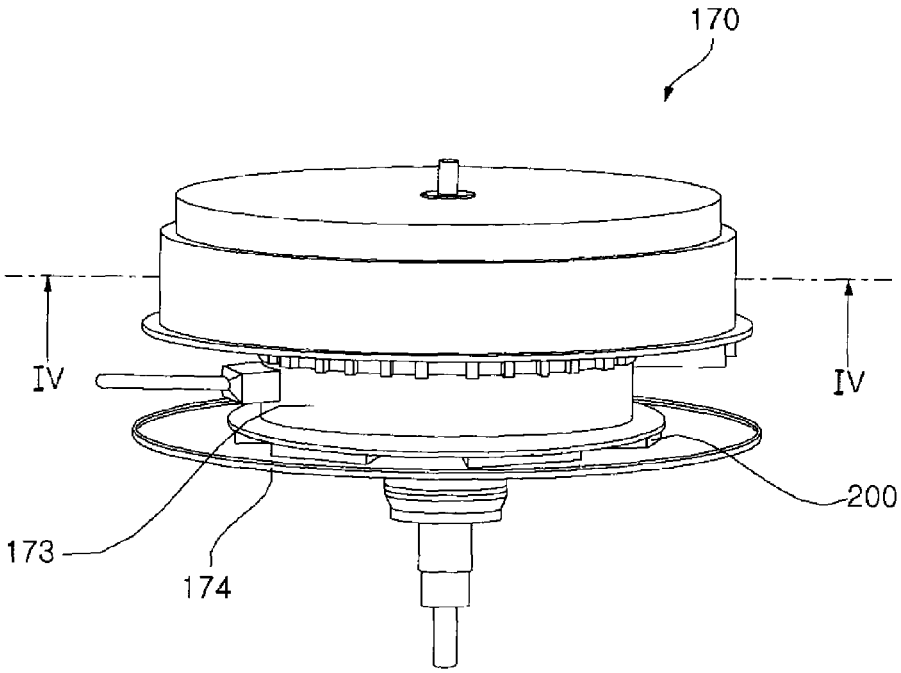
[Fig. 16]
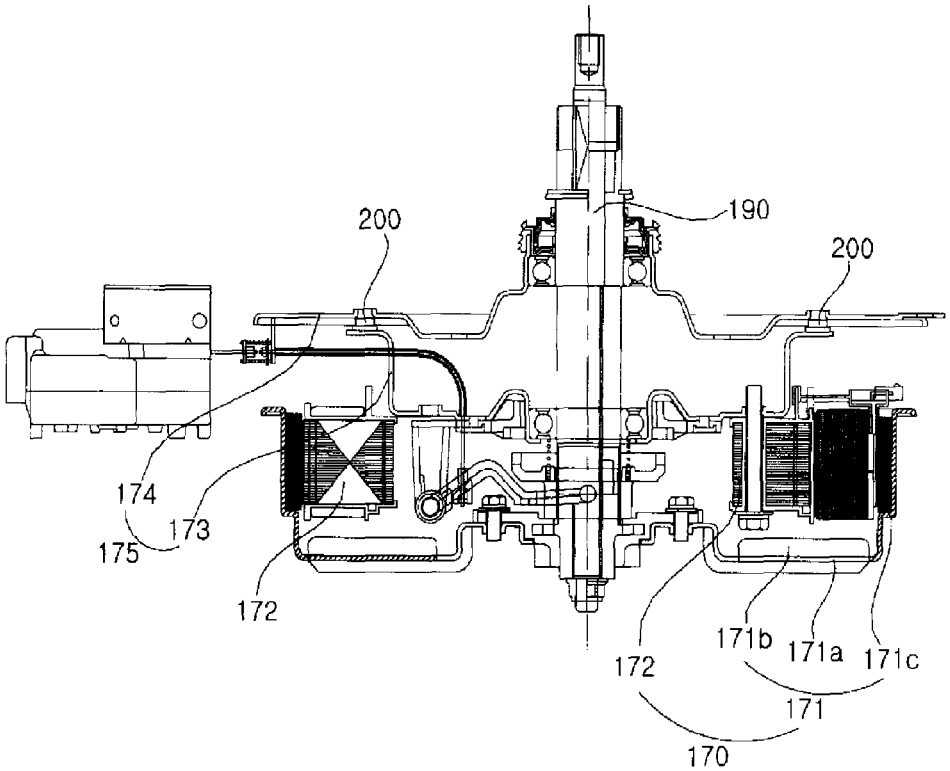

[Fig. 17]
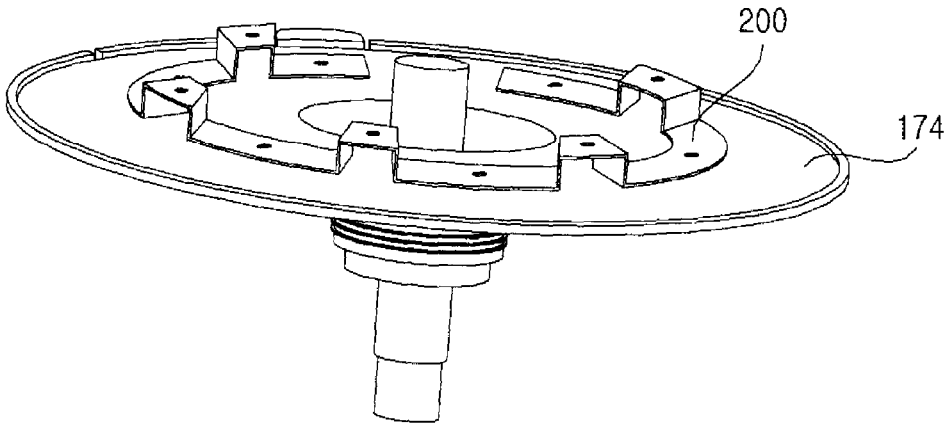
[Fig. 18]
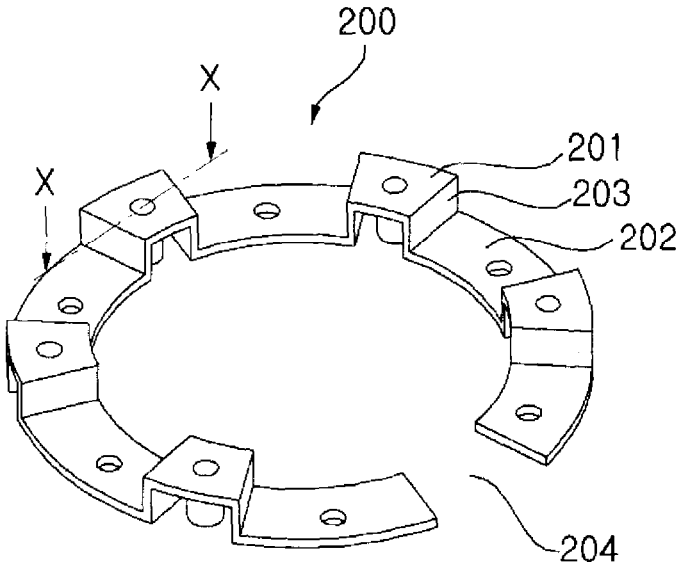

[Fig. 19]
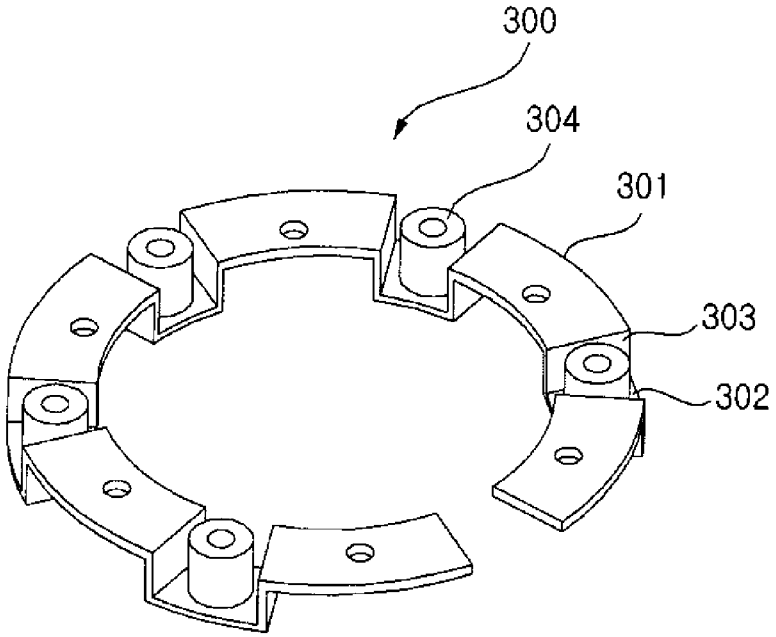
[Fig. 20]
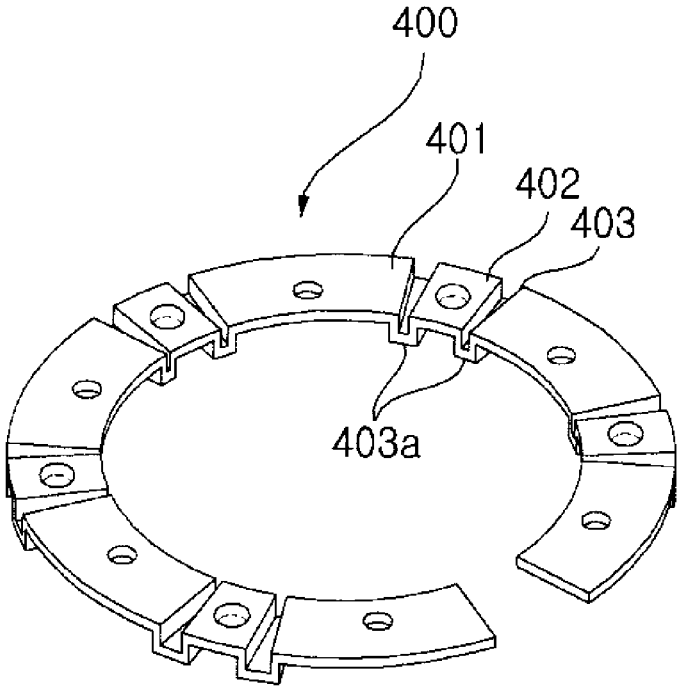

[Fig. 21]
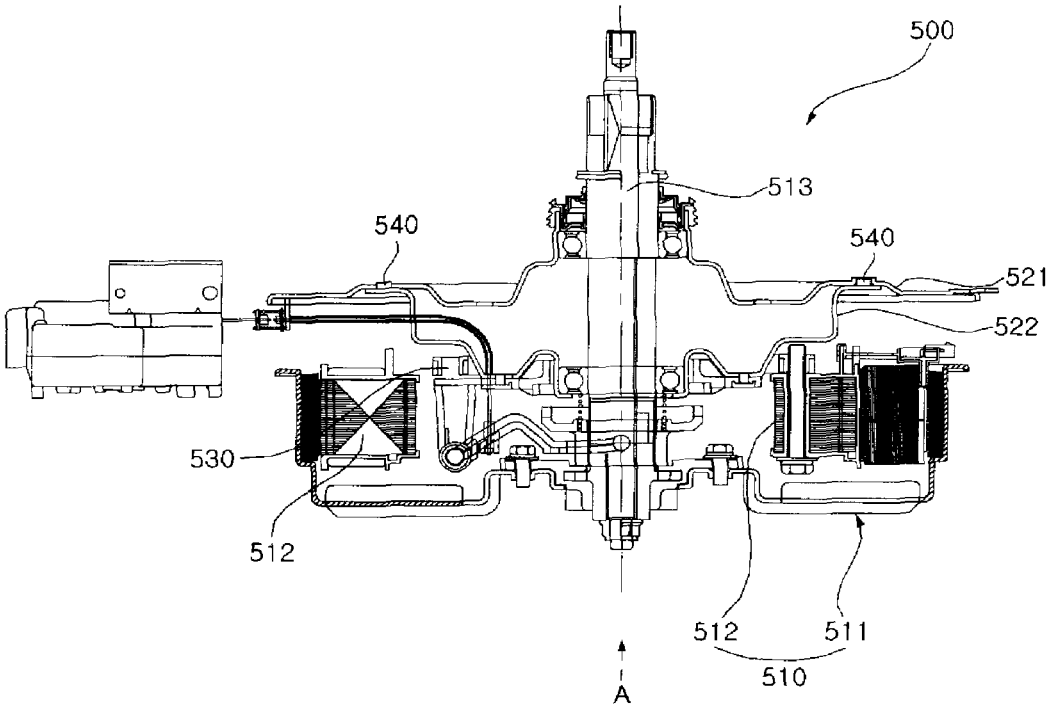

FABRIC TREATING MACHINE

TECHNICAL FIELD

The present invention relates to a fabric treating machine, and more particularly, to a fabric treating machine for decreasing the vibration transfer from a driving unit to the peripheral parts such as an inner tub.

BACKGROUND ART

In general, a laundry treatment is a device for washing or treating fabrics.

A fabric treating machine comprises an inner tub for accommodating fabrics, and a driving unit for generating a driving power to rotate the inner tub. The driving unit comprises a stator for generating an electromagnetic power and a rotator which is rotated by the electromagnetic power. The rotor is connected a rotary shaft which is directly connected the inner tub, so that the rotor transfers a rotary power to the inner tub.

The inner tub and the outer tub vibrate by vibration generated from the rotation of the rotor. Therefore, there is a problem that the vibration can generate a noise and the noise may give a user an unpleasant feeling.

DISCLOSURE OF INVENTION

Technical Problem

An object of the present invention is to provide a fabric treating machine which may reduce the vibration transfer from a driving unit to the peripheral parts.

Solution to Problem

According to an aspect of the present invention, there is provided a fabric treating machine comprising a driving unit which comprises a rotor, a stator and a rotary shaft and generates a rotary power, and a bearing unit for supporting the rotary shaft; and a first vibration mitigation part which is disposed between the stator and the bearing unit and reduces the vibration transfer between the stator and the bearing unit as the one side of which is connected to the stator and the other side of which is connected to the bearing unit.

According to an another aspect of the present invention, there is provided a fabric treating machine comprising an upper bearing unit which a rotary shaft is inserted in and an outer tub is connected to; and a lower bearing unit which a rotary shaft is inserted in and a driving unit is fixed to; and a vibration mitigation part which is disposed between the upper bearing unit and the lower bearing unit and reduces the vibration transfer between the upper bearing unit and the lower bearing unit as the one side of which is connected to the upper bearing unit and the other side of which is connected to the lower bearing unit.

Also, according to an another aspect of the present invention, there is provided a fabric treating machine comprising a driving unit which comprises a rotor, a stator and a rotary shaft and generates a rotary power; and an upper bearing unit which a rotary shaft is inserted in and an outer tub is connected to; and a lower bearing unit which a rotary shaft is inserted in and a driving unit is fixed to; and a first vibration mitigation part which is disposed between the stator and the lower bearing unit and reduces the vibration transfer between the stator and the lower bearing unit as the one side of which is connected to the stator and the other side of which is connected to the lower bearing unit; and a second vibration mitigation part which is disposed between the upper bearing unit and the lower bearing unit and reduces the vibration transfer between the upper bearing unit and the lower bearing unit as the one side of which is connected to the upper bearing unit and the other side of which is connected to the lower bearing unit.

ADVANTAGEOUS EFFECTS OF INVENTION

A fabric treating machine according a present invention comprises a first vibration mitigation part which is disposed between a stator and a bearing unit. Therefore, it is possible to reduce the vibration transfer from the driving unit to the bearing unit, the vibration of an inner tub and an outer tub can be reduced, and a noise can be reduced. In addition, it is possible to improve a reliability of product.

In addition, a fabric treating machine according a present invention comprises a vibration mitigation part which is disposed between an upper bearing unit and a lower bearing unit. Therefore, it can reduce the vibration transfer from the lower bearing unit to the upper bearing unit, the vibration of an inner tub and an outer tub can be reduced, and a noise can be reduced.

BRIEF DESCRIPTION OF DRAWINGS

FIG. 1 is a perspective view which illustrates a fabric treating machine according to the present invention.

FIG. 2 is a cross-sectional view taken along line II-II of FIG. 1.

FIG. 3 is a cross-sectional view which illustrates a driving device according to a first exemplary embodiment of the present invention.

FIG. 4 is a perspective view which illustrates the lower bearing unit and the first vibration mitigation part shown in the direction of 'A' in FIG. 3.

FIG. 5 is a perspective view which illustrates the first vibration mitigation part shown in FIG. 4.

FIG. 6 is a drawing which illustrates a connector and the second vibration mitigation part shown in FIG. 3.

FIG. 7 is a perspective view which illustrates the second vibration mitigation part shown in FIG. 3.

FIG. 8 is a drawing which illustrates an exemplary embodiment about vibration of the first vibration mitigation part shown in FIG. 5.

FIG. 9 is a drawing which illustrates another exemplary embodiment about vibration of the first vibration mitigation part shown in FIG. 5.

FIG. 10 is a drawing which illustrates an exemplary embodiment about connection of the bearing connection portion and the stator connection portion shown in FIG. 5.

FIG. 11 is a drawing which illustrates another exemplary embodiment about connection of the bearing connection portion and the stator connection portion shown in FIG. 5.

FIG. 12 is a drawing which illustrates another exemplary embodiment about connection of the bearing connection portion and the stator connection portion shown in FIG. 5.

FIG. 13 is a perspective view which illustrates a first vibration mitigation part according to the second exemplary embodiment of the present invention.

FIG. 14 is a perspective view which illustrates a first vibration mitigation part according to the third exemplary embodiment of the present invention.

FIG. 15 is a perspective view which illustrates a vibration mitigation part of a driving device according to the fourth exemplary embodiment of the present invention.

FIG. 16 is a cross-sectional view taken along line IV-IV of FIG. 15.

FIG. 17 is a perspective view which illustrates the upper bearing unit and the vibration mitigation part shown in FIG. 15.

FIG. 18 is a perspective view which illustrates the vibration mitigation part shown in FIG. 17.

FIG. 19 is a perspective view which illustrates a vibration mitigation part according to the fifth exemplary embodiment of the present invention.

FIG. 20 is a perspective view which illustrates a vibration mitigation part according to the sixth exemplary embodiment of the present invention.

FIG. 21 is a perspective view which illustrates a driving device according to the seventh exemplary embodiment of the present invention.

BEST MODE FOR CARRYING OUT THE INVENTION

FIG. 1 is a perspective view which illustrates a fabric treating machine according to the present invention. FIG. 2 is a cross-sectional view taken along line II-II of FIG. 1

Referring to FIG. 1 and FIG. 2, a fabric treating machine 100 comprises a cabinet 2, an outer tub 115 which is disposed at the inside of the cabinet 100 and contains water, an inner tub 122 which is disposed at the inside of the outer tub 115 and has fabric loaded therein, a driving device 150 which generates a driving power for rotating the inner tub 122, a water supply assembly (not shown) for supplying water to the inside of the outer tub 115 and the inner tub 122, and a drain assembly (not shown) for draining the water contained in the outer tub 115.

The cabinet 110 comprises a cabinet body 111, a base 112 which is disposed at the bottom of the cabinet body 111, a cover 123 which is disposed at the top of the cabinet body 111 and is connected to the cabinet body 111, a control panel 126 which is disposed at the one side of the cover 123 and is connected to the cabinet body 111.

An input device is disposed at the control panel 126 so that a user inputs an operation order by the input device.

FIG. 3 is a cross-sectional view which illustrates a driving device according to a first exemplary embodiment of the present invention.

Referring to FIG. 3, the driving device 150 comprises a driving unit 170 for generating a driving power, a rotary shaft 190 which is directly connected to the driving unit 170 and transmits the driving power to the inner tub 122, and a bearing unit 175 for supporting the rotary shaft 190.

The driving unit 170 may include a motor, etc. The driving unit 170 comprises a stator 172, and a rotor 171 which is rotated by the electromagnetic power generated from the stator 172.

The stator 172 comprises a body (not shown), and a coil (not shown) which is coiled around the one side of the body and generates an electromagnetic power.

The rotor 171 comprises a rotor body 171*a*, a blade 172*b* which is formed at the one side of the rotor body 171*a* and discharges a heat generated from the rotor body 171*a* to the outside, and a magnetic body 171*c* which is connected to the rotor body 171*a* and moves by the electromagnetic power.

An operation of the driving unit 170 will hereinafter be described in detail. A user inputs an operation order to the input device (not shown) to operate the fabric treating machine 100. If the operation order is inputted, the currents flow through the driving unit 170. As the currents flow through the driving unit 170, the currents flow through the coil and the coil generates an electromagnetic power. If the electromagnetic power is generated, the magnetic body 171*c* gets a force by the electromagnetic power.

As stated above, the magnetic body 171*c* is connected to the rotor body 171*a*, so that the rotor 171 is rotated. As the rotor 171 is rotated, the rotary shaft 190 connected to a connector 176 is rotated. The rotary shaft 190 is directly connected to the inner tub 122, so that the inner tub 122 is rotated by the rotation of the rotary shaft 190.

The driving unit 170 further includes a connector 176 which connects the rotary shaft 190 to the rotor body 171*a*. The rotary shaft 190 is connected with the rotor 171 by the connector 176, so that the rotary shaft 190 is rotated by the rotation of the rotor 171.

The bearing unit 175 comprises an upper bearing unit 174 which a rotary shaft 190 is inserted in and an outer tub 115 is connected to, and a lower bearing unit 173 which a rotary shaft 190 is inserted in an the upper bearing unit 174 is connected to. A clutch 177 is disposed at the inside of the upper bearing unit 174 and the lower bearing unit 173 and changes a rotation method during a washing course and a dehydrating course.

A first vibration mitigation part 180 is disposed between the bearing unit 175 and the stator 172. The first vibration mitigation 180 may reduce the vibration transfer between the stator 172 and the bearing unit 175 as the one side of which is connected to the stator 172 and the other side of which is connected to the bearing unit 175.

FIG. 4 is a perspective view which illustrates the lower bearing unit and the first vibration mitigation part shown in the direction of 'A' in FIG. 3. FIG. 5 is a perspective view which illustrates the first vibration mitigation part shown in FIG. 4.

Referring to FIG. 3, FIG. 4, and FIG. 5, the first vibration mitigation part 180 is connected to the under surface of the lower bearing unit 173.

The first vibration mitigation part 180 is shaped of an open ring and is a panel which is multiply bent to up and down direction.

The first vibration mitigation part 180 comprises a plurality of bearing connection portions 181 which are connected to the lower bearing unit 173 and are disposed separately each other with the prescribed intervals, and a plurality of stator connection portions 182 which are connected to the stator 172, and a connection portions 183 which connects the plurality of bearing connection portions 181 to plurality of stator connection portions 182.

The plurality of the bearing connection portions 181 and the stator connection portions 182 and the connection portions 183 are formed in a body The plurality of bearing connection portions 181 and the plurality of stator connection portions 182 are disposed on the different plane each other. The plurality of bearing connection portions 181 are disposed to contact with the lower bearing unit 173, and the plurality of stator connection portions 182 are disposed to contact with the stator 172 by being bent from the plurality of bearing connection portions 181.

The bearing connection portions 181 are disposed to contact with the lower bearing unit 173 and are fixed on the lower bearing unit 173 by a connector such as a bolt. The stator connection portions 182 are disposed to contact with the stator 172 and are fixed on the stator 172 by a connector as a bolt. Thus, the lower bearing unit 173 and the stator 172 are separately disposed each other and may be connected by the first vibration mitigation part 190.

The connection portion 183 is formed by being bent from the bearing connection portions 181 and the stator connection portions 182. The connection portion 183 is formed to lean at a prescribed angle towards the bearing connection portions 181 and the stator connection portions 182. In the exemplary embodiment of the present invention, it is described that the connection portion 183 is formed perpendicularly to each of the plurality of bearing connection portions 181 and the plurality of the stator connection portions 182.

A connection hole may be formed in the bearing connection portions 181 and the stator connection portions 182 for inserting the connector (not shown). The connection hole of the bearing connection portions 181 may be disposed in the first circumferential direction. The connection hole of the stator connection portions 182 may be disposed in the second circumferential direction. The first circumferential direction and the second circumferential direction may be same or different each other. In the exemplary embodiment of the present invention, it is described that the first circumferential direction and the second circumferential direction are same.

The plurality of the bearing connection portions 181 and the plurality of the stator connection portions 182 may be disposed separately each other with the prescribed intervals. The bearing connection portions 181 may be disposed among the stator connection portions 182.

The first vibration mitigation part 180 is made from metal. It is desirable that the first vibration mitigation part 180 is made from the different material with the bearing unit 175 and the stator 172. In the exemplary embodiment of the present invention, it is described that the first vibration mitigation part 180 is made from aluminum. If the first vibration mitigation part 180 is made from the same material with the bearing unit 175 or the stator 172, the first vibration mitigation part 180 vibrates along with the bearing unit 175 and the stator 172. It may cause resonance of the first vibration mitigation part 180. Thus, the vibrations may be increased.

The first vibration mitigation part 180 is shaped of the open ring and includes an opening 185. By including the opening 185, it prevents a deformation which is caused by the vibrations or the external forces.

FIG. 6 is a drawing which illustrates a connector and the second vibration mitigation part shown in FIG. 3. FIG. 7 is a perspective view which illustrates the second vibration mitigation part shown in FIG. 3.

Referring to FIG. 7, the fabric treating machine according to the present invention further includes a second vibration mitigation part 189 which is disposed between the rotor 170 and the connector 176 and reduces the vibration the vibration generated from the rotor 170 and the rotary shaft 190.

The second vibration mitigation part 189 is disposed between the rotor body 171*a* and the connector 176. The second vibration mitigation part 189 may be shaped of disk. The second vibration mitigation part 189 may be made from elastic material.

The second vibration mitigation part 189 absorbs the vibration generated between the rotor 170 and the rotary shaft 190 so that the noise from the vibration can be reduced.

FIG. 8 is a drawing which illustrates an exemplary embodiment about vibration of the first vibration mitigation part shown in FIG. 5. FIG. 9 is a drawing which illustrates another exemplary embodiment about vibration of the first vibration mitigation part shown in FIG. 5.

If the currents flow through the driving unit 170, the rotor 171 is rotated and the vibration is generated from the rotor 171. If the rotor 171 is rotated, the rotary shaft 190 vibrates and the stator 172 vibrates. As the stator 172 vibrates, the vibration of the stator 172 may transfer to the bearing unit 175. Because the first vibration mitigation part 180 is disposed between the stator 172 and the bearing unit, the first vibration mitigation part 180 can absorb and reduce some of the vibration of the stator 172.

Referring to FIG. 8, the absorption method of the first vibration mitigation part 180 will hereinafter be described in detail.

The vibration generated from the stator 172 is transferred through the one side 182*a* and another side 182*b* of the stator connection portions 182. The transfer direction of the vibration transferring through the one side 182*a* and another side 182*b* of the stator connection portion 182 is the direction of the C. Namely, the vibration generated from the stator connection portions 182 are transferred to the bearing connection portions 181.

A reflected wave is formed in the bearing connection portions 181 in the direction of the C' reversed from the direction of the C. The reflected wave is formed in the center of the bearing connection portions 181 towards the left and right direction C of that.

Therefore, the vibration of the direction C and the vibration of the direction C' may be offset each other so that the vibration can be reduced.

Referring FIG. 9, as above, if the stator 172 and the bearing unit 175 are vibrated, the displacement of the first vibration mitigation part 180 may be changed.

If at least one of the stator 172 and the bearing unit 175 is vibrated, the connection portions 183 formed by being bent from the stator connection portions 182 and the bearing connection portions 181 move in the direction D of the vibration and absorb the vibrations. Therefore, it can be reduced the vibration transfer from any one of the stator 172 and the bearing unit 175 to the other.

FIG. 10 is a drawing which illustrates an exemplary embodiment about connection of the bearing connection portion and the stator connection portion shown in FIG. 5. FIG. 11 is a drawing which illustrates another exemplary embodiment about connection of the bearing connection portion and the stator connection portion shown in FIG. 5. FIG. 12 is a drawing which illustrates another exemplary embodiment about connection of the bearing connection portion and the stator connection portion shown in FIG. 5.

Referring to FIG. 10, FIG. 11, and FIG. 12, the bearing connection portions 181 and the stator connection portions 182 are disposed to be parallel to each other, and the connection portion 183 is disposed to lean at a prescribed angle towards the bearing connection portions 181 and the stator connection portions 182.

Referring to FIG. 10, the connection portion 183 and the bearing connection portions 181 may form a right angle (θ1), and the connection portion 183 and the stator connection portions 182 may form a right angle (θ1).

Referring to FIG. 11, the connection portion 183 and the bearing connection portions 181 may form an obtuse angle (θ2), and the connection portion 183 and the stator connection portions 182 may form an obtuse angle (θ2).

Referring to FIG. 12, the connection portion 183 and the bearing connection portions 181 may form an acute angle (θ3), and the connection portion 183 and the stator connection portions 182 may form an acute angle (θ3).

As above, because the connection portions 183 of the first vibration mitigation part 180 is bent so as to lean at an prescribed angle towards the bearing connection portions 181 and the stator connection portions 182, it is possible to absorb the vibration more effectively.

FIG. 13 is a perspective view which illustrates a first vibration mitigation part according to the second exemplary embodiment of the present invention.

Referring to FIG. 3, the first vibration mitigation part 280 according to the second exemplary embodiment of the present invention comprises a plurality of bearing connection portions 281 which are connected to the bearing unit 175, a plurality of stator connection portions 282 which are connected to the stator 172, a plurality of connection portions 283 which connects the plurality of bearing connection portions 281 and the stator connection portion 282, and a boss 286 which is formed at the one of the bearing connection portion 281 and the stator connection portion 286 so as to insert a bolt. Detailed description about the same elements as the first exemplary embodiment is skipped. A same number in figures indicates the same element.

The boss 286 may be projected from one of the bearing connection portion 281 and the stator connection portion 282 to the other. In the exemplary embodiment, it is described that the boss 286 is projected from the stator connection portion 281 to a height of the bearing connection portion 281.

A bolt is inserted into the boss 286 for connecting the stator connection portion 282 and the stator 172. Because the boss 286 is formed as above, the assembling of the first vibration mitigation part 280 can be simple.

FIG. 14 is a perspective view which illustrates a first vibration mitigation part according to the third exemplary embodiment of the present invention.

Referring to FIG. 14, the first vibration mitigation part 380 according to the third exemplary embodiment of the present invention comprises a plurality of bearing connection portions 381 which are connected to the bearing unit 175, a plurality of stator connection portions 382 which are connected to the stator 172, a plurality of connection portions 383 which connects the plurality of bearing connection portions 381 and the stator connection portion 382, wherein the connection portion 383 includes a groove or a protrusion which is bent to up and down direction. Detailed description about the same elements as the first exemplary embodiment is skipped. A same number in figures indicates the same element.

The bearing connection portion 381 and the stator connection portion 382 may be disposed at a different level. In the exemplary embodiment, it is described that the bearing connection portion 381 and the stator connection portion 382 are disposed at a same level. The boss may be formed at any one of the bearing connection portion 381 and the stator connection portion 382 for inserting a bolt.

The connection portion 383 includes a groove 383*a* which is bent to the down direction from the bearing connection portion 381 and the stator connection portion 382.

FIG. 15 is a perspective view which illustrates a vibration mitigation part of a driving device according to the fourth exemplary embodiment of the present invention. FIG. 16 is a cross-sectional view taken along line IV-IV of FIG. 15.

Referring to FIG. 15 and FIG. 16, the vibration mitigation part 200 according to the fourth exemplary embodiment of the present invention is disposed between the upper bearing unit 174 and the lower bearing unit 173 and reduces the vibration transfer between the upper bearing unit 174 and the lower bearing unit 173 as the one side of which is connected to the upper bearing unit 174 and the other side of which is connected to the lower bearing unit 173. Detailed description about the same elements as the first exemplary embodiment is skipped. A same number in figures indicates the same element.

FIG. 17 is a perspective view which illustrates the upper bearing unit and the vibration mitigation part shown in FIG. 15. FIG. 18 is a perspective view which illustrates the vibration mitigation part shown in FIG. 17.

Referring to FIG. 17 and FIG. 18, the vibration mitigation part 200 is shaped of an open ring and is bent to up and down direction many times.

The vibration mitigation part 200 comprises a plurality of upper bearing connection portions 201 which are connected to the upper bearing unit 174 and are disposed separately each other with prescribed intervals apart, and a plurality of lower bearing connection portions 202 which are connected to the lower bearing unit 173 and are disposed among the plurality of upper bearing connection portions 201, and a connection portions 203 which connects the plurality of upper bearing connection portions 201 to the plurality of lower bearing connection portions 202.

A plurality of the upper bearing connection portions 201 and the lower bearing connection portions 202 and the connection portions are formed in a body.

The plurality of upper bearing connection portions 201 and the plurality of lower connection portions 202 are disposed on the different plane each other. The plurality of upper bearing connection portions 201 are disposed to contact with the upper bearing unit 174, and the plurality of lower bearing connection portions 202 are disposed to contact with the lower bearing unit 173 by being bent from the plurality of upper bearing connection portions 201.

The upper bearing connection portions 201 are disposed to contact with the upper bearing unit 174 and are fixed on the lower bearing unit 173 by a connector such as a bolt. The lower bearing connection portions 202 are disposed to contact with the lower bearing unit 173 and are fixed on the lower bearing unit 173 by a connector as a bolt. Thus, the lower bearing unit 173 and the upper bearing unit 174 are separately disposed each other and may be connected by the vibration mitigation part 200.

The connection portion 203 is formed by being bent from the upper bearing connection portions 201 and the lower bearing connection portions 202. The connection portion 203 is formed to lean at a prescribed angle towards the upper bearing connection portions 201 and the lower bearing connection portions 202. In the exemplary embodiment of the present invention, it is described that the connection portion 203 is formed perpendicularly to each of the plurality of upper bearing connection portions 201 and the plurality of the lower bearing connection portions 202.

A connection hole may be formed in the upper bearing connection portions 201 and the lower bearing connection portions 202 for inserting the connector (not shown). The connection hole of the upper bearing connection portions 201 may be disposed in the first circumferential direction. The connection hole of the lower bearing connection portions 202 may be disposed in the second circumferential direction. The first circumferential direction and the second circumferential direction may be same or different each other. In the exemplary embodiment of the present invention, it is described that the first circumferential direction and the second circumferential direction are same.

The plurality of the upper bearing connection portions 201 and the plurality of the lower bearing connection portions 202 may be disposed separately each other with the prescribed intervals. The upper bearing connection portions 201 may be disposed among the lower bearing connection portions 202.

The vibration mitigation part 200 is made from metal. It is desirable that the vibration mitigation part 200 is made from the different material with the bearing unit 175. In the exemplary embodiment of the present invention, it is described that the vibration mitigation part 200 is made from aluminum. If the vibration mitigation part 200 is made from the same material with the bearing unit 175, the vibration mitigation part 200 vibrates along with the bearing unit 175. It may cause resonance of the vibration mitigation part 200. Thus, the vibrations may be increased.

The vibration mitigation part 200 is shaped of the open ring and includes an opening 204. By including the opening 204, it can prevent a deformation of the vibration mitigation part 200 which is caused by the vibrations or the external forces.

The vibration or the deformation of the vibration mitigation part 200 according to the second exemplary embodiment of the present invention is similar to that of the first exemplary embodiment. Detailed description about the same elements as the first exemplary embodiment is skipped.

FIG. 19 is a perspective view which illustrates a vibration mitigation part according to the fifth exemplary embodiment of the present invention.

Referring to FIG. 19, a vibration mitigation part 300 according to the fifth exemplary embodiment of the present invention comprises a plurality of upper bearing connection portions 301 which are connected to the upper bearing unit 174, and a plurality of lower bearing connection portions 302 which are connected to the lower bearing unit 173, and a connection portions 303 which connects the plurality of upper bearing connection portions 301 to the plurality of lower bearing connection portions 302, and a boss 304 which is disposed at the one of the upper bearing connection portions 301 and the lower bearing connection portions 302 so as to insert a bolt. Detailed description about the same elements as the fourth exemplary embodiment is skipped. A same number in figures indicates the same element.

A boss 304 may be projected from one of the upper bearing connection portions 301 and the lower bearing connection portions 302 to the other. In the exemplary embodiment, it is described that the boss 304 is projected from the lower bearing connection portion 302 to a height of the upper bearing connection portion 301.

A bolt is inserted into the boss 304 for connecting the lower bearing connection portion 302 and the lower bearing 173. Because of the boss 304, the assembling of the vibration mitigation part 300 can be simple.

FIG. 20 is a perspective view which illustrates a vibration mitigation part according to the sixth exemplary embodiment of the present invention.

Referring to FIG. 20, a vibration mitigation part 400 according to the sixth exemplary embodiment of the present invention comprises a plurality of upper bearing connection portions 401 which are connected to the upper bearing unit 174, and a plurality of lower bearing connection portions 402 which are connected to the lower bearing unit 173, and a connection portions 403 which connects the plurality of upper bearing connection portions 401 to the plurality of lower bearing connection portions 402, wherein the connection portion 403 includes a groove or a protrusion which is bent to up and down direction. Detailed description about the same elements as the fourth exemplary embodiment is skipped. A same number in figures indicates the same element.

The upper bearing connection portion 401 and the lower bearing connection portion 402 may be disposed at a different level. In the exemplary embodiment, it is described that the upper bearing connection portion 401 and the lower bearing connection portion 402 are disposed at a same level. The boss may be formed at any one of the upper bearing connection portion 401 and the lower bearing connection portion 402 for inserting a bolt.

The connection portion 403 includes a groove 403*a* which is bent to the down direction from the upper bearing connection portion 401 and the lower bearing connection portion 402.

As above, the connection portion 403 is multiple bent so that the vibration may be absorbed.

FIG. 21 is a perspective view which illustrates a driving device according to the seventh exemplary embodiment of the present invention.

Referring to FIG. 21, a driving device 500 according to the seventh exemplary embodiment of the present invention, a driving unit 510 which comprises a rotor 511, a stator 512 and a rotary shaft 513 and generates a rotary power, an upper bearing unit 521 which a rotary shaft 513 is inserted in and an outer tub is connected to, and a lower bearing unit 522 which a rotary shaft 513 is inserted in and a driving unit 510 is fixed to, and a first vibration mitigation part 530 which is disposed between the stator 512 and the lower bearing unit 522 and reduces the vibration transfer between the stator 512 and the lower bearing unit 522 as the one side of which is connected to the stator 512 and the other side of which is connected to the lower bearing unit 522, and a second vibration mitigation part 530 which is disposed between the upper bearing unit 521 and the lower bearing unit 522 and reduces the vibration transfer between the upper bearing unit 521 and the lower bearing unit 522 as the one side of which is connected to the upper bearing unit 521 and the other side of which is connected to the lower bearing unit 522.

The shape of the first vibration mitigation part 530 is similar to the shape of the first vibration mitigation part 180 according to the first exemplary embodiment of the present invention. Detailed description about the first vibration mitigation part 530 is skipped. And, the shape of the second vibration mitigation part 540 is similar to the shape of the first vibration mitigation part 200 according to the fourth exemplary embodiment of the present invention. Detailed description about the first vibration mitigation part 540 is skipped.

As above, the first vibration mitigation part 530 is disposed between the stator 512 and the lower bearing unit 522 so that it is possible to reduce the vibration transferred from the stator 512 to the lower bearing unit 522.

Also, the second vibration mitigation part 540 is disposed between the upper bearing unit 521 and the lower bearing unit 522 so that it is possible to reduce the vibration transferred from the lower bearing unit 522 to the upper bearing unit 521.

Therefore, the noise generated by the vibration can be reduced.

Although the present invention has been described with reference to the embodiments shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

The invention claimed is:

1. A fabric treating machine comprising:

an outer tub which is configured to contain water;

an inner tub which is disposed in the outer tub and configured to receive fabric therein;

a driving unit which comprises a rotor, a stator and a rotary shaft and generates a rotary power;

a bearing unit in which the rotary shaft is inserted, wherein the bearing unit is fixed to the outer tub; and a first vibration mitigation part which is made separately from the bearing unit and is disposed between the stator and the bearing unit to reduce a vibration transfer between the stator and the bearing unit, wherein the first vibration mitigation part comprises:

a plurality of bearing connection portions which are connected to the bearing unit and are disposed separately from each other with prescribed intervals in a circumferential direction on a first plane;

a plurality of stator connection portions which are connected to the stator and are disposed between the bearing connection portions in the circumferential direction on a second plane parallel to the first plane; and a plurality of connection portions which are disposed in an up and down direction to connect the plurality of bearing connection portions to the plurality of stator connection portions in the circumferential direction, wherein the bearing connection portions, the connection portions, and the stator connection portions are connected to each other to form a one piece body having a continuous ring shape, and wherein the one piece body includes only a single gap between a pair of spaced ends such that the one piece body has a continuous ring shape between the pair of spaced ends.

2. The fabric treating machine of claim 1, wherein the plurality of bearing connection portions are disposed to contact with the bearing unit, and the plurality of stator connection portions are disposed to contact with the stator by bending from the plurality of bearing connection portions.

3. The fabric treating machine of claim 1, wherein the connection portions are formed to lean at a prescribed angle towards the bearing connection portions and the stator connection portions.

4. The fabric treating machine of claim 3, wherein the connection portions are formed perpendicularly to the bearing connection portions or the stator connection portions.

5. The fabric treating machine of claim 1, wherein at least one of the bearing connection portions and the stator connection portions includes a boss which is projected from one of the bearing connection portions and the stator connection portions to a height of the other of the bearing connection portions and the stator connection portions and is formed for inserting a bolt.

6. The fabric treating machine of claim 1, wherein the first vibration mitigation part is not made from a same material as the bearing unit.

7. The fabric treating machine of claim 1, further comprising a second vibration mitigation part which is disposed at the rotor and reduces vibration generated by the rotor, the second vibration mitigation part comprising a disk.

8. The fabric treating machine of claim 1, wherein the bearing unit comprises:

an upper bearing part into which the rotary shaft is inserted, the upper bearing part being fixedly connected to the outer tub; and a lower bearing part into which the rotary shaft is inserted, the upper bearing part being connected to the lower bearing part, and wherein the plurality of bearing connection portions are connected to the lower bearing part.

* * * * *